US008307904B2

(12) United States Patent
Surjaatmadja

(10) Patent No.: US 8,307,904 B2
(45) Date of Patent: Nov. 13, 2012

(54) SYSTEM AND METHOD FOR MAINTAINING POSITION OF A WELLBORE SERVICING DEVICE WITHIN A WELLBORE

(75) Inventor: Jim Basuki Surjaatmadja, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 321 days.

(21) Appl. No.: 12/773,481

(22) Filed: May 4, 2010

(65) Prior Publication Data

US 2011/0272164 A1 Nov. 10, 2011

(51) Int. Cl.
*E21B 19/02* (2006.01)

(52) U.S. Cl. ..... 166/382; 166/212

(58) Field of Classification Search ..... 166/212, 166/382

See application file for complete search history.

(56) References Cited

U.S. PATENT DOCUMENTS

| | | | | |
|---|---|---|---|---|
| 3,273,645 | A | 9/1966 | Der Mott | |
| 3,797,589 | A * | 3/1974 | Kellner et al. | 175/94 |
| RE28,449 | E * | 6/1975 | Edmond | 175/94 |
| 4,067,386 | A | 1/1978 | Weise | |
| 4,141,414 | A * | 2/1979 | Johansson | 166/212 |
| 4,410,051 | A | 10/1983 | Daniel et al. | |
| 4,438,810 | A | 3/1984 | Wilkinson | |
| 4,739,842 | A | 4/1988 | Kruger et al. | |
| 5,020,591 | A | 6/1991 | Shore | |
| 5,107,927 | A | 4/1992 | Whiteley et al. | |
| 5,259,466 | A | 11/1993 | Venditto et al. | |
| 5,273,121 | A | 12/1993 | Kitney et al. | |
| 5,343,966 | A | 9/1994 | Wenzel et al. | |
| 5,988,286 | A * | 11/1999 | Dwiggins | 166/382 |
| 6,213,205 | B1 | 4/2001 | Surjaatmadja | |
| 6,234,259 | B1 | 5/2001 | Kuckes et al. | |
| 6,283,208 | B1 | 9/2001 | George et al. | |
| 6,336,502 | B1 | 1/2002 | Surjaatmadja et al. | |
| 6,364,038 | B1 | 4/2002 | Driver | |

(Continued)

FOREIGN PATENT DOCUMENTS

EP 0313374 A1 4/1989

(Continued)

OTHER PUBLICATIONS

Office Action dated Dec. 30, 2011 (18 pages), U.S. Appl. No. 12/703,366, filed Feb. 10, 2010.

(Continued)

*Primary Examiner* — William P Neuder

(74) *Attorney, Agent, or Firm* — John W. Wustenberg; Conley Rose, P.C.

(57) ABSTRACT

A method of maintaining a location of a wellbore servicing device includes connecting a pressure activated hold-down tool (PAHT) to the wellbore servicing device, delivering the wellbore servicing device and the PAHT into a wellbore, selectively increasing a curvature of the PAHT in response to a change in a fluid pressure, and engaging the PAHT with a feature of a wellbore to prevent longitudinal movement of the wellbore servicing device. A PAHT has pressure actuated elements that selectively provide an unactuated state in which the PAHT lies substantially along a longitudinal axis and the pressure actuated elements selectively lie increasingly deviated from the longitudinal axis in response to a change in pressure applied to the PAHT. At least one of the pressure actuated elements has a tooth configured for selective resistive engagement with a feature of the wellbore.

22 Claims, 8 Drawing Sheets

U.S. PATENT DOCUMENTS

| | | | | |
|---|---|---|---|---|
| 6,662,874 | B2 | 12/2003 | Surjaatmadja et al. | |
| 6,725,933 | B2 | 4/2004 | Middaugh et al. | |
| 6,827,148 | B2 | 12/2004 | Shaw et al. | |
| 6,935,423 | B2 * | 8/2005 | Kusmer | 166/217 |
| 6,938,690 | B2 | 9/2005 | Surjaatmadja | |
| 6,976,507 | B1 | 12/2005 | Webb et al. | |
| 7,172,038 | B2 | 2/2007 | Terry et al. | |
| 7,188,671 | B2 | 3/2007 | Al-Zahrani | |
| 7,216,726 | B2 | 5/2007 | Swietlik et al. | |
| 7,278,491 | B2 | 10/2007 | Scott | |
| 7,404,416 | B2 | 7/2008 | Schultz et al. | |
| 7,497,259 | B2 | 3/2009 | Leising et al. | |
| 7,617,871 | B2 | 11/2009 | Surjaatmadja et al. | |
| 7,886,842 | B2 | 2/2011 | Howard et al. | |
| 8,061,426 | B2 | 11/2011 | Surjaatmadja | |
| 2002/0104686 | A1 * | 8/2002 | Bloom et al. | 175/99 |
| 2006/0086507 | A1 | 4/2006 | Surjaatmadja et al. | |
| 2011/0192599 | A1 | 8/2011 | Surjaatmadja et al. | |
| 2011/0272164 | A1 | 11/2011 | Surjaatmadja | |

FOREIGN PATENT DOCUMENTS

| | | | |
|---|---|---|---|
| EP | 1489260 | A1 | 12/2004 |
| GB | 2452416 | A | 3/2009 |
| WO | 2010064010 | A2 | 6/2010 |
| WO | 2010064010 | A3 | 6/2010 |
| WO | 2011098767 | A2 | 8/2011 |
| WO | 2011098767 | A3 | 8/2011 |

OTHER PUBLICATIONS

Office Action dated Mar. 29, 2012 (7 pages), U.S. Appl. No. 12/703,366, filed Feb. 10, 2010.

Foreign communication from a related counterpart application—International Search Report and Written Opinion, PCT/GB2011/000181, Mar. 7, 2012, 11 pages.

Notice of Allowance dated Apr. 17, 2012 (6 pages), U.S. Appl. No. 12/703,366, filed Feb. 10, 2010.

Nakhwa, A. D., et al., "Oriented perforating using abrasive fluids through coiled tubing," SPE 107061, 2007, pp. 1-7, Society of Petroleum Engineers.

Patent application entitled "Apparatus and methods for servicing a wellbore," by Robert G. Howard, et al., filed Dec. 3, 2008 as U.S. Appl. No. 12/327,600.

Patent application entitled "System and method for lateral wellbore entry, debris removal, and wellbore cleaning," by Jim B. Surjaatmadja, filed Dec. 16, 2009 as U.S. Appl. No. 12/639,244.

Patent application entitled "System and method for determining position within a wellbore," by Jim B. Surjaatmadja, et al., filed Feb. 10, 2010 as U.S. Appl. No. 12/703,366.

Surjaatmadja, Jim B., et al., "An effective sweep-cleaning of large deviated wellbores using small coiled-tubing systems," SPE 94102, 2005, pp. 1-9, Society of Petroleum Engineers.

Office Action dated Jun. 27, 2011 (15 pages), U.S. Appl. No. 12/639,244, filed Dec. 16, 2009.

Foreign communication from a related counterpart application—International Search Report and Written Opinion, PCT Application PCT/GB2009/002808, Aug. 2, 2010, 12 pages.

Office Action dated Sep. 24, 2010 (18 pages), U.S. Appl. No. 12/327,600, filed Dec. 3, 2008.

Notice of Allowance dated Jan. 5, 2011 (9 pages), U.S. Appl. No. 12/327,600, filed Dec. 3, 2008.

Notice of Allowance dated Oct. 5, 2011 (5 pages), U.S. Appl. No. 12/639,244, filed Dec. 16, 2009.

Notice of Allowance dated Jul. 27, 2012 (17 pages), U.S. Appl. No. 12/703,366, filed Feb. 10, 2010.

* cited by examiner

SYSTEM AND METHOD FOR MAINTAINING POSITION OF A WELLBORE SERVICING DEVICE WITHIN A WELLBORE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This invention relates to systems and methods of maintaining a position of a wellbore servicing device within a wellbore.

BACKGROUND OF THE INVENTION

It is sometimes necessary to secure the position of a wellbore servicing device so that operation of the wellbore servicing device is performed at a selected location along the length of the wellbore. As such, some so-called hold-down systems provide robust holding strength for preventing movement of wellbore servicing devices. Some hold-down systems comprise mechanical slips and/or wedges that effectively force grips and/or teeth radially outward and into engagement with the wellbore and/or a casing of the wellbore. However, some hold-down systems are susceptible to becoming stuck or otherwise incapable of easy selective dislodging from the wellbore and/or the casing as a result of sand, dirt, and/or other matter interfering with operation of the hold-down systems. Further, some hold-down systems require special and/or extraneous wellbore service procedures to activate and/or deactivate the hold-down systems. In other words, some hold-down systems require wellbore service procedures (e.g., wellbore intervention or trip-ins) in addition to the wellbore service procedures required by the wellbore servicing device secured by the hold-down system. Some hold-down systems are capable of providing sufficient holding forces but fail to provide any centralizing and/or selective radial placement of the secured wellbore servicing device within the wellbore. Accordingly, there is a need for systems and methods for holding a wellbore servicing device in position within a wellbore with a reduced risk of becoming undesirably lodged within the wellbore. There is also a need for systems and method for providing both hold-down functionality and centralizing and/or selective radial placement of a secured wellbore servicing device within a wellbore. There is also a need for systems and methods for holding a wellbore servicing device in position without requiring special and/or additional wellbore servicing procedures.

SUMMARY OF THE INVENTION

Disclosed herein is a method of maintaining a location of a wellbore servicing device. The method may comprise connecting a pressure activated hold-down tool to the wellbore servicing device, delivering the wellbore servicing device and the pressure activated hold-down tool into a wellbore, selectively increasing a curvature of the pressure activated hold-down tool in response to a change in a fluid pressure, and engaging the pressure activated hold-down tool with a feature of a wellbore to prevent longitudinal movement of the wellbore servicing device.

Also disclosed herein is a pressure activated hold-down tool for a wellbore. The pressure activated hold-down tool may comprise pressure actuated elements configured to cooperate to selectively provide an unactuated state in which the pressure activated hold-down tool lies substantially along a longitudinal axis and the pressure actuated elements are further configured to cooperate to selectively lie increasingly deviated from the longitudinal axis in response to a change in pressure applied to the pressure activated hold-down tool. At least one of the pressure actuated elements may comprise a tooth configured for selective resistive engagement with a feature of the wellbore.

Also disclosed herein is a method of servicing a wellbore. The method of servicing a wellbore may comprise delivering a pressure activated hold-down tool into the wellbore, the pressure activated hold-down tool being connected to a wellbore servicing device, increasing a pressure applied to the pressure activated hold-down tool and the wellbore servicing device, and increasing a deviation of a curvature of the pressure activated hold-down tool from a longitudinal axis of the pressure activated hold-down tool in response to the increasing the pressure. The method may further comprise engaging the pressure activated hold-down tool with a feature of the wellbore to resist a longitudinal movement of at least one of the pressure activated hold-down tool and the wellbore servicing device and servicing the wellbore using the wellbore servicing device.

DETAILED DESCRIPTION OF THE PREFERRED EMBODIMENTS

Figure 1:
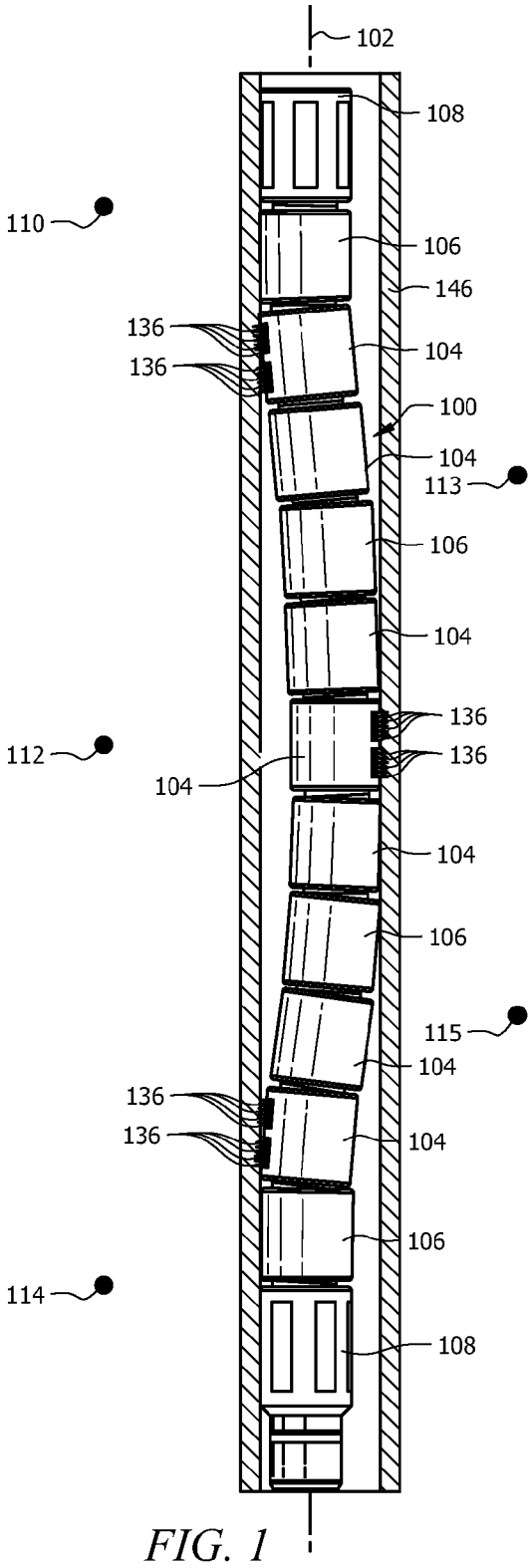
FIG. 1 is a simplified schematic view of pressure activated hold-down tool (PAHT) according to an embodiment of the disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Disclosed herein are systems and methods for maintaining a position of a wellbore servicing device within a wellbore. In some embodiments, the systems and methods described herein may be used to pass a pressure activated hold-down tool (PAHT) through a variety of components within a wellbore while the PAHT is in an unactuated state. The PAHT may be actuated by increasing a fluid pressure applied to the PAHT to cause the PAHT to mechanically interfere with a component within the wellbore, thereby maintaining a position of a wellbore servicing device attached to the PAHT. In some embodiments, a PAHT may comprise a pressure actuated bendable tool that, on the one hand, is configured to lie generally along a longitudinal axis when unactuated, but on the other hand, is configured to deviate from the longitudinal axis in response to a change in fluid pressure. A greater understanding of pressure actuated bendable tools and elements of their design may be found in U.S. Pat. No. 6,213,205 B1 (hereinafter referred to as the '205 patent) and U.S. Pat. No. 6,938,690 B2 (hereinafter referred to as the '690 patent) which are hereby incorporated by reference in their entireties. In some embodiments, the PAHT may be configured for selective actuation in response to a change in pressure and configured to selectively engage a tubular, pipe, and/or casing disposed in a wellbore (i.e., a production tubing and/or casing string of a wellbore) and/or a portion of a wellbore.

FIG. 1 is a simplified schematic diagram of a PAHT 100 according to an embodiment. Most generally, the PAHT 100 is configured for delivery downhole into a wellbore using any suitable delivery component, including, but not limited to, using coiled tubing and/or any other suitable delivery component of a workstring that may be traversed within the wellbore along a length of the wellbore. In some embodiments, the delivery component may also be configured to deliver a fluid pressure applied to the PAHT 100. For example, in an embodiment where the delivery component used to deliver the PAHT 100 is coiled tubing, the coiled tubing may also serve to deliver a selectively varied fluid pressure to the PAHT 100 through an internal fluid path of the coiled tubing. While the PAHT 100 is shown in an actuated state in FIG. 1, the PAHT 100 may be delivered downhole and/or otherwise traversed within a wellbore in an unactuated state where the components of the PAHT 100 generally lie coaxially along a longitudinal axis 102 of the unactuated PAHT 100. In some embodiments, the longitudinal axis 102 may lie substantially coaxially and/or substantially parallel with a longitudinal axis of a wellbore component, such as, but not limited to, a casing string and/or a tubing string through which the PAHT 100 may be traversed.

The PAHT 100 generally comprises a plurality of bend elements 104, a plurality of reverser elements 106, and two adapter elements 108. Because the PAHT 100 is shown in an actuated state, the bend elements 104, reverser elements 106, and adapter elements 108 cooperate to generally cause deviation of the components of the PAHT 100 from the longitudinal axis 102 instead of causing the elements to lie substantially coaxially along the longitudinal axis 102. Such deviation of the PAHT 100 components from the longitudinal axis 102 may be accomplished by the cooperation of the bend elements 104, reverser elements 106, and adapter elements 108. Cooperation of the bend elements 104 and the adapter elements 108 may be accomplished in any of the suitable manners disclosed in the above mentioned '205 and '690 patents. Particularly, some aspects of the bend elements 104 may be substantially similar to aspects of the members 82, 84, 86, 88 of the '690 patent while some aspects of the adapter elements 108 may be substantially similar to aspects of the adapter sub 80 of the '690 patent. Transitioning the PAHT 100 between the actuated and unactuated states may be initiated and/or accomplished in response to a change in pressure applied to the PAHT 100 and/or to a change in a pressure differential applied to the PAHT 100 in any of the suitable manners disclosed in the above mentioned '205 and '690 patents.

While the PAHT 100 may be configured to lie substantially along the longitudinal axis 102 when in an unactuated state, it will be appreciated that the interposition of the reverser elements 106 between bend elements 104 may cause an undulation in the general curvature of the PAHT 100. As shown in FIG. 1, the PAHT 100 comprises four reverser elements 106 which may, in some embodiments, cause the PAHT 100 to comprise an undulating curvature that generally correlates to a plurality of centers of curvature. For example, the actuated PAHT 100 may comprise an undulating curve correlated to five distinct centers of curvature.

Figure 2:
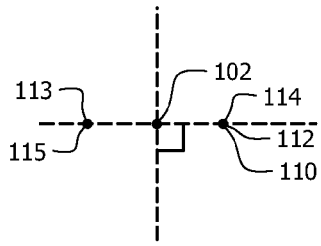
FIG. 2 is a schematic orthogonal top view showing a longitudinal axis of the PAHT of FIG. 1 relative to centers of curvature of the pressure activated hold-down tool of FIG. 1.

Referring now also to FIG. 2 (a schematic orthogonal top view of the location of the longitudinal axis 102 relative to the centers of curvature described in further detail below), a first center of curvature 110 may be conceptualized as existing generally at a first radial offset from the longitudinal axis 102, in a first angular location about the longitudinal axis 102, and at a first longitudinal location relative to the longitudinal length of the PAHT 100. Further, a second center of curvature 112 may be conceptualized as also existing generally at the first radial offset from the longitudinal axis 102, also in a first angular location about the longitudinal axis 102, but at a second longitudinal location relative to the longitudinal length of the PAHT 100 different from the first longitudinal location of the first center of curvature 110. Still further, a third center of curvature 114 may be conceptualized as also existing generally at the first radial offset from the longitudinal axis 102, also in a first angular location about the longitudinal axis 102, but at a third longitudinal location relative to the longitudinal length of the PAHT 100 different from the first longitudinal location of the first center of curvature 110 and different from the second longitudinal location of the second center of curvature 112.

Similarly, a fourth center of curvature 113 may be conceptualized as also existing at the first radial offset from the longitudinal axis 102, in a second angular location about the longitudinal axis 102 where the second angular location is angularly offset from the first angular location about the longitudinal axis 102, and at a fourth longitudinal location relative to the longitudinal length of the PAHT 100 where the fourth longitudinal location is located between the first longitudinal location and the second longitudinal location. Further, a fifth center of curvature 115 may be conceptualized as also existing at the first radial offset from the longitudinal axis 102, in the second angular location about the longitudinal axis 102, and at a fifth longitudinal location relative to the longitudinal length of the PAHT 100 where the fifth longitudinal location is located between the second longitudinal location and the third longitudinal location.

In the above-described embodiment, the first center of curvature 110, the second center of curvature 112, and the third center of curvature 114 are located in substantially the same angular location about the longitudinal axis 102 while the fourth center of curvature 113 and the fifth center of curvature 115 are located substantially offset by about 180 degrees about the longitudinal axis 102 centers of curvature 110, 112, and 114. It will be appreciated that in other embodiments, centers of curvatures of a PAHT 100 may be located with different and/or unequal radial spacing, different and/or unequal angular locations about the longitudinal axis 102, and/or different and/or unequal longitudinal locations relative to the longitudinal length of the PAHT 100.

In some embodiments, the undulating curvature of the actuated PAHT 100 may simulate a sine wave and/or other wave function that generally provides at least two curve inflection points and/or two transitions between positive slope and negative slope. In other embodiments, the undulating curvature may not be uniform and/or may comprise more than two curve inflection points and/or two transitions between positive slope and negative slope. Further, some embodiments of a PAHT 100 may comprise no reverser elements 106 resulting in a single center of curvature. Still further, while the curvature of the actuated PAHT 100 shown in FIG. 1 is easily described in terms of a two dimensional curve, it will be appreciated that other embodiments may comprise three dimensional curvatures that cause the curvature of an actuated PAHT 100 to exhibit a spiral, corkscrew, helical, and/or any non-uniform three-dimensional curvature.

Figure 3:
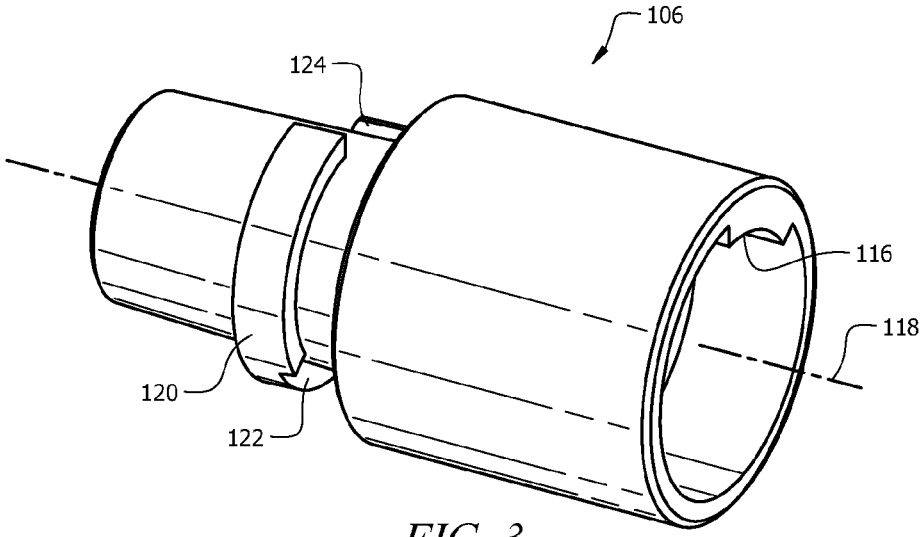
FIG. 3 is a an oblique view of a reverser element of the PAHT of FIG. 1.

Referring now to FIG. 3, an oblique view of a reverser element 106 is shown. Reverser element 106 is substantially similar to bend elements 104 but for the location of a reverser lug 116. The reverser element 106 may be described as comprising a reverser longitudinal axis 118 that generally lies coaxially with longitudinal axis 102 when the PAHT 100 is in the unactuated state. The reverser element 106 further comprises a reverser ring 120 that has a reverser notch 122 and a reverser channel 124 angularly offset about the reverser longitudinal axis 118 from the reverser notch 122. The relative locations of the reverser notch 122 and the reverser channel 124, in this embodiment, are substantially similar to the relative locations of the notch 94*a* and the channel 94*b* of the ring 94 of the '690 patent. However, unlike the lug 90*a* of the '690 patent, the reverser lug 116 is angularly aligned with the reverser channel 124 rather than the reverser notch 122. Accordingly, interposition of the reverser element 106 between bend elements 104 provides the undulating curvature of the actuated PAHT 100 with the above described curve inflection point and/or transition between positive slope and negative slope. Of course, in other embodiments, the relative angular locations of the reverser lug 116, the reverser notch 122, and the reverser channel 124 may be different to provide any one of the above-described three-dimensional curvatures.

Figure 4:
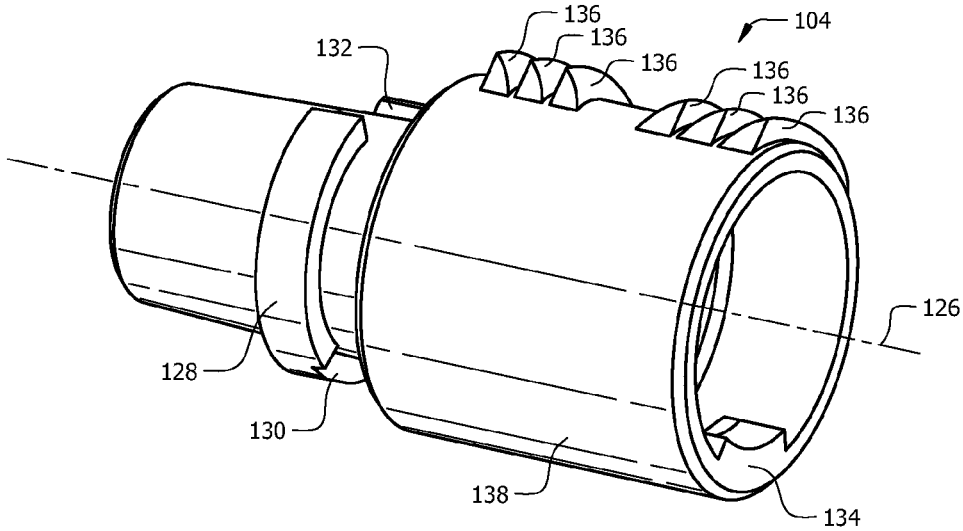
FIG. 4 is an oblique view of a bend element of the PAHT of FIG. 1.

Referring now to FIG. 4, an oblique view of a bend element 104 is shown. The bend element 104 may be described as comprising a bend longitudinal axis 126 that generally lies coaxially with longitudinal axis 102 when the PAHT 100 is in the unactuated state. The bend element 104 further comprises a bend ring 128 that has a bend notch 130 and a bend channel 132 angularly offset about the bend longitudinal axis 126 from the bend notch 130. The relative locations of the bend notch 130, the bend channel 132, and a bend lug 134, in this embodiment, are substantially similar to the relative locations of the notch 94*a* and the channel 94*b* of the ring 94 of the '690 patent. In other embodiments, the relative angular locations of the bend lug 134, the bend notch 130, and the bend channel 132 may be different to provide any one of the above-described three-dimensional curvatures.

Referring now to FIGS. 1 and 4, one or more bend elements 104 may be provided with one or more teeth 136. In an embodiment, the teeth 136 are generally formed as sharp protrusions extending radially from a body 138 of the bend element 104. The teeth 136 may comprise directional geometries allowing some teeth 136 to strongly engage a wall within a wellbore in a first direction (e.g., an uphole direction) while other teeth 136 may comprise directional geometries allowing strong engagement in a second direction substantially opposite the first direction (e.g., a downhole direction). In other embodiments, teeth 136 may extend continuously (or discontinuously, e.g., in discrete segments) about the entire circumference of the body 138. In an embodiment, the teeth 136 may engage a casing 146 or other wall within a wellbore. While teeth 136 are shown as comprising substantially triangular cross-sectional shapes, it will be appreciated that any other suitable shape and/or configuration of one or more teeth 136 may be provided. Teeth 136 may be formed integral with body 138 and/or may be provided to the body 138 via any additive process, such as, but not limited to, welding, bonding, implanting, and/or any other suitable manner of affixing teeth 136 to the body 138. In some embodiments, implants may be hardened buttons comprising tungsten carbide and the hardened buttons may be implanted at strategic locations on an outside wall of one or more of the bend elements 104. Further, while teeth 136 are shown as being provided on bend elements 104, in other PAHT 100 embodiments, teeth 136 may similarly be provided on reverser elements 106 and/or adapter elements 108.

FIG. 1 further shows that the adapter elements 108 may be forced by the pressurized combination of bend elements 104 and reverser elements 106 to lie substantially centralized within the casing 146. In other words, the adapter elements 108 may be forced into coaxial alignment with the longitudinal axis 102 in response to the PAHT 100 being actuated by sufficient pressurization.

Figure 5:
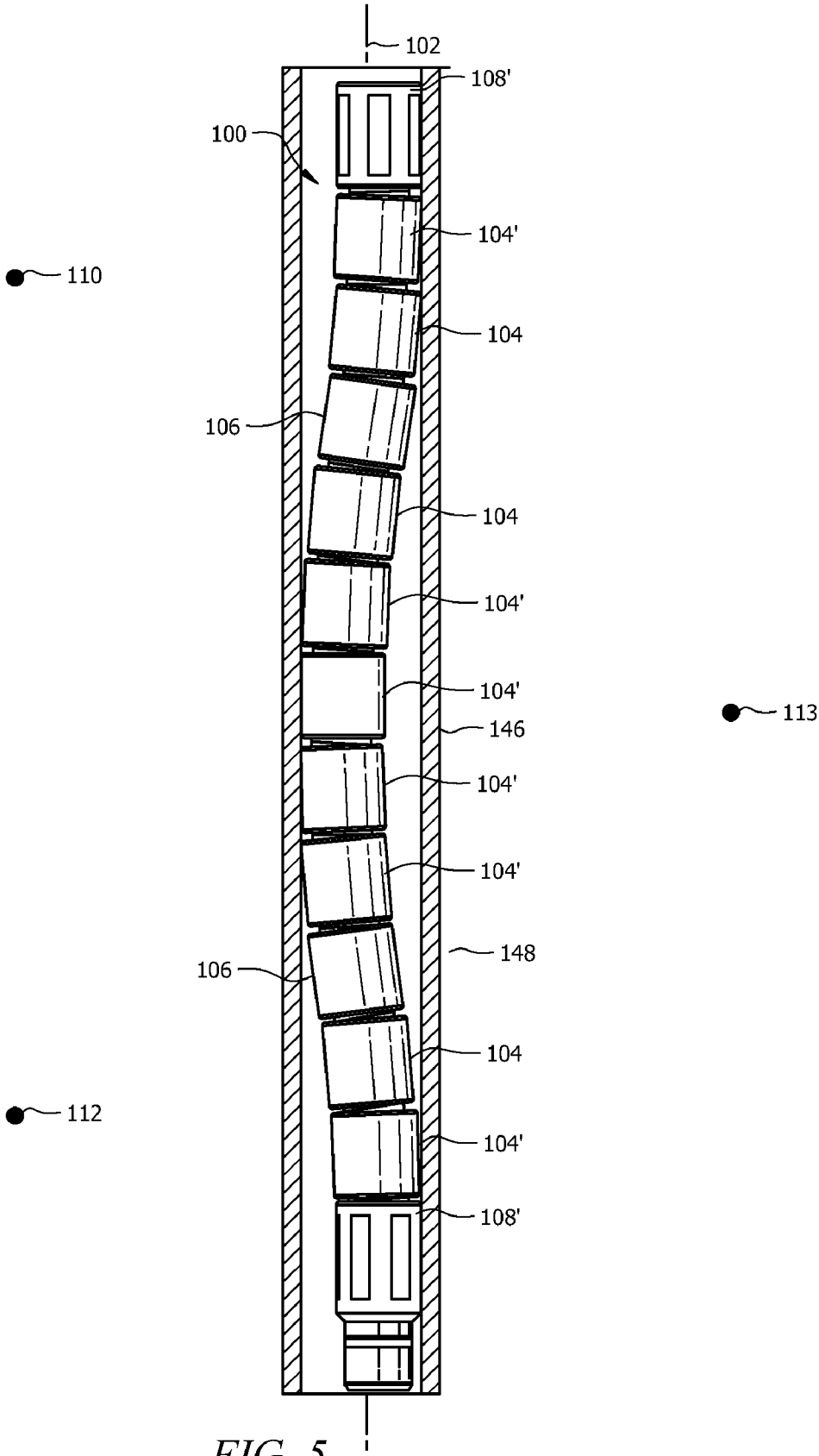
FIG. 5 is a simplified schematic view of an alternative embodiment of a PAHT according to the disclosure.

Referring now to FIG. 5, an alternative embodiment of a PAHT 100 is shown. In some embodiments, a PAHT 100 may comprise a combination of bend elements 104 and reverser elements 106 selected to force the adapter elements 108 into decentralized positions relative to the longitudinal axis 102. Considering the PAHTs 100 of FIGS. 1 and 5, it can be seen that PAHTs 100 may be provided that force one or more adapter elements 108 of a PAHT 100 into any desired location relative to the longitudinal axis 102 as a matter of design by appropriately selecting the sizes, quantities, and orders of relative placement of the bend elements 104 and reverser elements 106. Further, in the embodiment of FIG. 5, it will be appreciated that bend elements 104', reverser elements 106', and adapter elements 108' may be provided with teeth 136 for selective engagement with the casing 146 and/or any other suitable wall within a wellbore.

In operation, the PAHT 100 may be delivered into a wellbore and/or into a component of a wellbore, such as the casing 146 of a wellbore. Generally, the PAHT 100 may be delivered and/or otherwise deployed into a wellbore while the PAHT 100 is in an unactuated state so that the components of the PAHT 100 lie substantially along the longitudinal axis 102. The longitudinal axis 102 may be substantially coaxial with a longitudinal axis of the casing 146. By delivering the PAHT 100 to a desired location within the wellbore while the PAHT 100 is not actuated (and thereby minimizing contact during delivery), the PAHT 100 may cause very little wear to the casing 146 and the PAHT 100 itself during the delivery and/or deployment into the wellbore. Such delivery and/or deployment of the PAHT 100 into the wellbore may be monitored to provide operators and/or control systems feedback necessary to provide an estimated or educated guess of where within the wellbore the PAHT 100 is located. Many techniques exist for calculating the estimated location of the PAHT 100 during such delivery and/or deployment. A few techniques may include one or more of measuring a length of workstring and/or coiled tubing used to deploy the PAHT 100, measuring and/or monitoring a weight of the delivery device, and/or any other suitable method of estimating a location of the PAHT 100 within the wellbore.

The PAHT 100 may be actuated once the PAHT 100 is deployed to a desired location. Such actuation of the PAHT 100 may occur in response to a change in a fluid pressure applied to the PAHT 100. In some embodiments, a fluid pressure may be increased within a workstring and/or coiled tubing that is connected to the PAHT 100. The PAHT 100 may be configured so that an increase in fluid pressure delivered to the PAHT 100 may cause the above-described deviation of the PAHT 100 at least until so much deviation is caused to engage the PAHT 100 with a feature of the wellbore. In some embodiments, the teeth 136 may engage against and/or adjacent the feature of the wellbore. The feature of the wellbore may be any component, device, wall, pocket, joint, collar, window, perforation, opening, junction, and/or structure that is located within the wellbore and is suitable for resistive engagement with the PAHT 100 and/or the teeth 136 of the PAHT 100. In some embodiments, the teeth 136 of a single element 104, 106, 108 may apply a force of about 100-500 lbf against the interior wall of the casing 146. Of course, in other embodiments, a PAHT 100 may be configured to apply any other suitable force against the interior wall of the casing 146 or any other feature within the wellbore.

Figure 6:
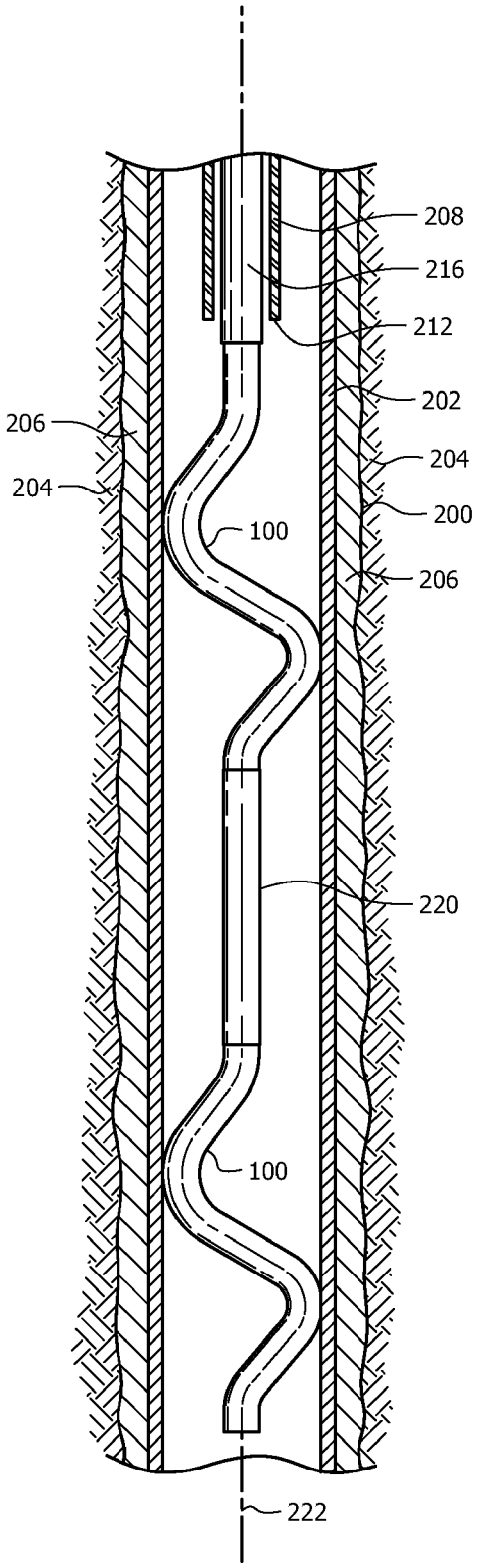
FIG. 6 is a partial cut-away view of two PAHTs of FIG. 1 maintaining the position of a wellbore servicing device and centralizing the wellbore servicing device.

Referring now to FIG. 6, a partial cut-away view of a PAHT 100 as deployed into a wellbore 200 is shown. The wellbore 200 comprises a casing 202 that is cemented in relation to the subterranean formation 204 through the use of cement 206. A tubing string 208 (e.g., production tubing) is disposed within the casing 202 but does not extend beyond a lower end of the casing 202. The tubing string 208 is received within the interior of the casing 202 and the delivery device, in this case a coiled tubing 216 device, is received within the interior of the tubing string 208. In some embodiments, the internal diameter of the casing 202 may be about 8 inches, the internal diameter of the tubing string 208 may be about 4.5 inches, and the largest diameter of the PAHT 100 may be about 3 inches. It will be appreciated that due to the flexible nature of the PAHT 100, the PAHT 100 may be delivered through the relatively smaller diameter of the tubing string 208 to thereafter selectively engage the relatively larger diameter casing 202. It will be appreciated that the PAHT 100 may be used to engage walls of wellbore components having a great variability in internal diameter. In some embodiments, the PAHT 100 may be capable of being delivered through an internal diameter of the tubing string 208 that is about 5% to about 80% smaller than the internal diameter of the casing 202.

In some embodiments, the PAHT 100 may be used to selectively lock a wellbore servicing device 220 in place within the wellbore 200, to thereafter perform a wellbore servicing operation using the wellbore servicing device 220, and to unlock the position of the wellbore servicing device 220 within the wellbore upon completion of the service. Upon movement of the workstring (e.g., the coiled tubing), the PAHT 100 may be used to further optionally repeat the locking and unlocking of the wellbore servicing device 220 location so that the wellbore servicing operation may be accomplished at various locations within the wellbore 200 despite the need to pass the PAHT 100 through relatively small internal component diameters. In this embodiment, the wellbore servicing device 220 is also carried by the coiled tubing 216 device and is generally fixed relative to the PAHT 100. In some embodiments, the PAHT 100 and the wellbore servicing device 220 may both be carried and/or delivered by the workstring (and/or any other suitable delivery device) and the wellbore servicing device 220 may be coupled to the workstring at a substantially fixed longitudinal location along the workstring relative to the PAHT 100. In some embodiments, the wellbore servicing device 220 may be a fracturing device, tubing punching device, perforation gun device, zonal isolation device, packer device, and/or acid work device. Accordingly, in some embodiments, the wellbore servicing operation performed by the wellbore servicing device 220 may be fracturing services, tubing punching services, perforation gun services, zonal isolation services, packer services, and/or acid work services. In an embodiment, the wellbore servicing device is a hydrojetting tool that may be used to perforate and/or fracture the wellbore and surrounding formation.

Still referring to FIG. 6, the wellbore servicing device 220 is connected between two PAHTs 100. In this embodiment, each of the PAHTs 100 is configured so that the wellbore servicing device 220 is substantially centralized and/or substantially coaxially aligned with longitudinal axis 222 of casing 202. As such, the PAHTs 100 may selectively centralize the wellbore servicing device 220 within the casing 202 and/or any other component of the wellbore 200.

Figure 7:
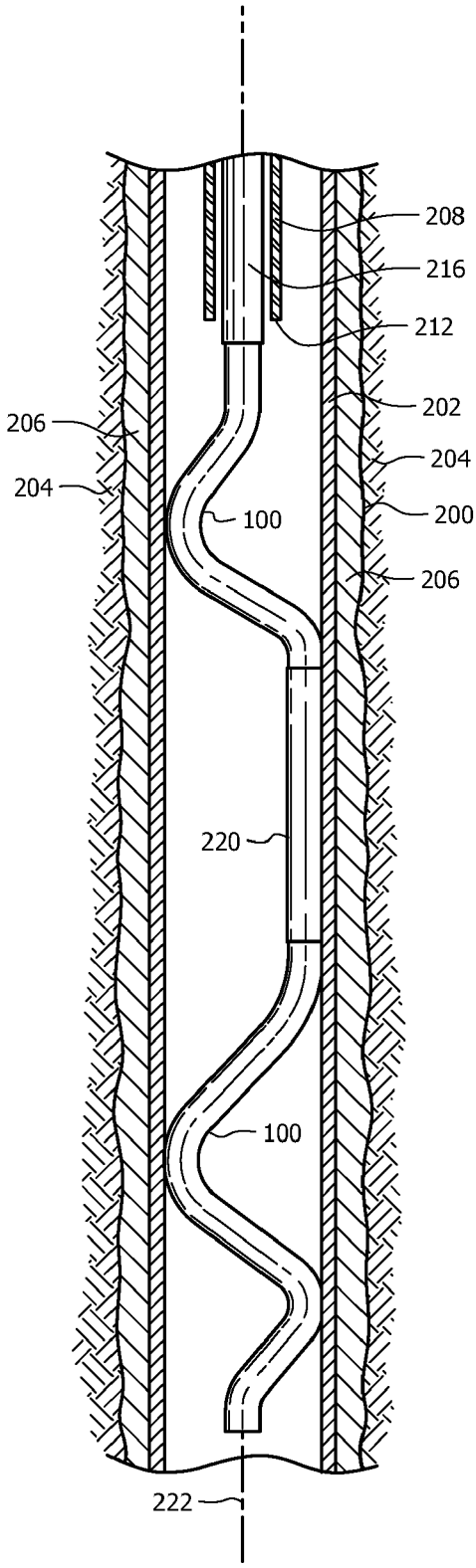
FIG. 7 is a partial cut-away view of two PAHTs of FIG. 1 maintaining the position of a wellbore servicing device and decentralizing the wellbore servicing device.

Referring now to FIG. 7, another embodiment is shown where the wellbore servicing device 220 is connected between two PAHTs 100. However, the PAHTs 100 of this embodiment are configured so that the wellbore servicing device 220 is substantially offset from the longitudinal axis 222 of casing 202. As such, the PAHTs 100 may selectively ensure decentralization of the wellbore servicing device 220 within the casing 202 and/or any other component of the wellbore 200. In this embodiment, the PAHTs 100 are configured so that the wellbore servicing device 220 is forced into position against the inner wall of casing 202. However, in alternative embodiments, the PAHTs 100 may be configured to cause any other selected amount of decentralization relative to the longitudinal axis 222 of casing 202.

Figure 8:
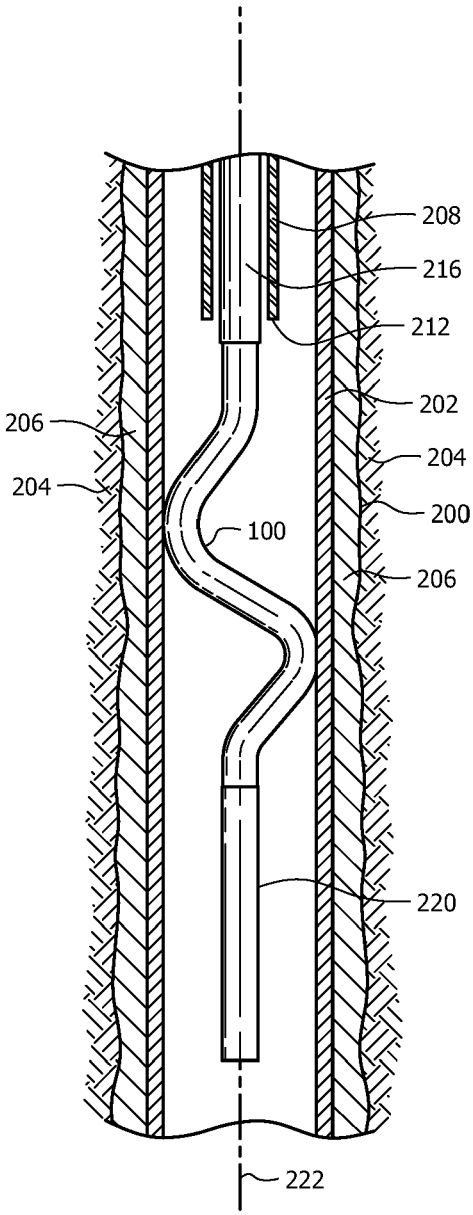
FIG. 8 is a partial cut-away view of one PAHT of FIG. 1 maintaining the position of a wellbore servicing device and centralizing the wellbore servicing device wherein the PAHT is located uphole of the wellbore servicing device.

Referring now to FIG. 8, a wellbore servicing device 220 is shown as being connected to a single PAHT 100 that is located relatively uphole from the wellbore servicing device 220. In this embodiment, the PAHT 100 is configured to selectively centralize the upper end of the wellbore servicing device 220 while the lower end of the wellbore servicing device 220 is not restrained by a PAHT 100. In other embodiments, other wellbore servicing components may be attached to the lower end of the wellbore servicing device 220. For example, any other suitable centralizing device may be connected to the lower end of the wellbore servicing device 220.

Figure 9:
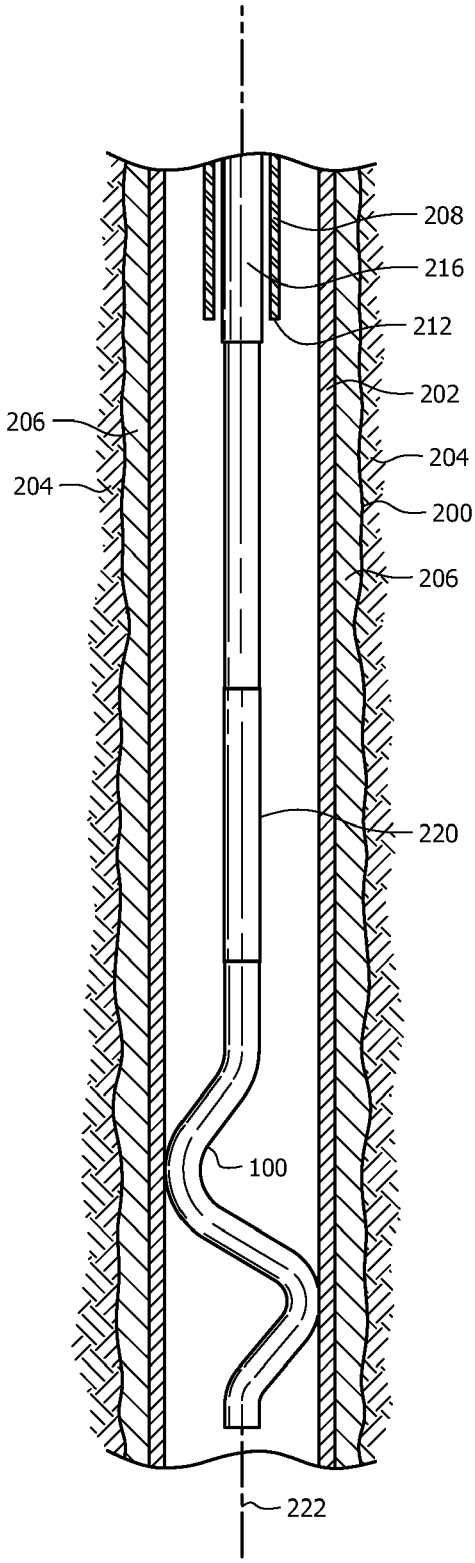
FIG. 9 is a partial cut-away view of one PAHT of FIG. 1 maintaining the position of a wellbore servicing device and centralizing the wellbore servicing device wherein the PAHT is located downhole of the wellbore servicing device.

Referring now to FIG. 9, a wellbore servicing device 220 is shown as being connected to a single PAHT 100 that is located relatively downhole from the wellbore servicing device 220. In this embodiment, the PAHT 100 is configured to selectively centralize the lower end of the wellbore servicing device 220 while the upper end of the wellbore servicing device 220 is connected to the coiled tubing 216. In other embodiments, other wellbore servicing components may be attached to the upper end of the wellbore servicing device 220 and/or the lower end of the PAHT 100. For example, any other suitable centralizing device may be connected to the upper end of the wellbore servicing device 220.

Figure 10:
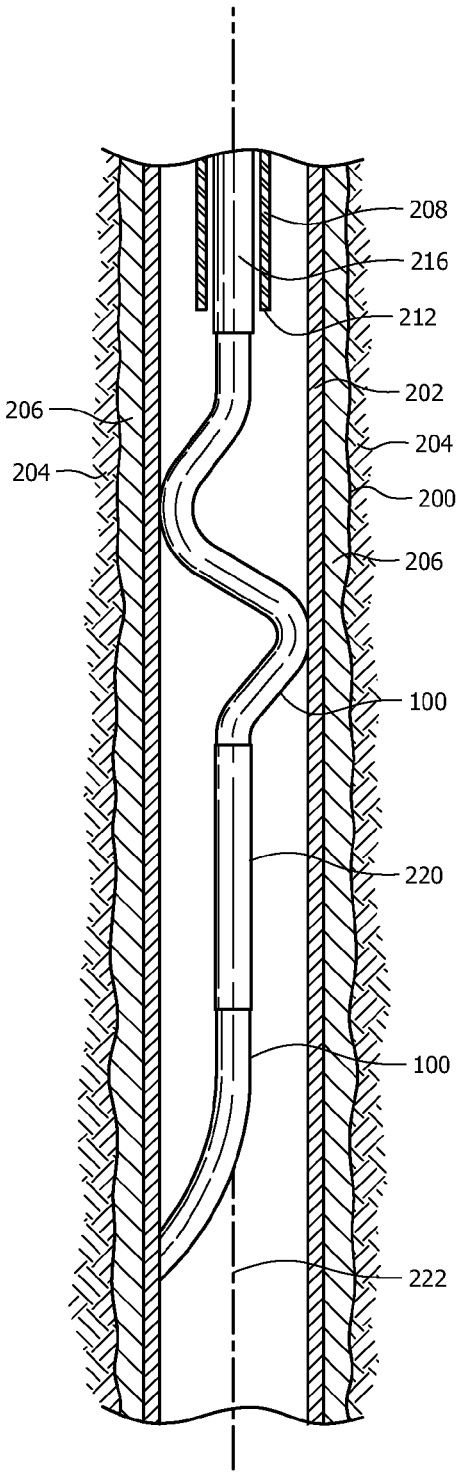
FIG. 10 is a partial cut-away view of one PAHTs of FIG. 1 and a second alternative embodiment of a PAHT maintaining the position of a wellbore servicing device and centralizing the wellbore servicing device wherein the PAHT of FIG. 1 is located uphole of the wellbore servicing device and wherein the second alternative embodiment of a PAHT is located downhole of the wellbore servicing device and comprises no reverser element.

Referring now to FIG. 10, another embodiment is shown where the wellbore servicing device 220 is connected between two PAHTs 100. The upper PAHT 100 of this embodiment is substantially similar to the upper PAHT 100 of FIG. 6. However, the lower PAHT 100 of this embodiment, while also configured to centralize the wellbore servicing device 220, is configured differently from the upper PAHT 100 of FIG. 6. More specifically, the lower PAHT 100 of FIG. 10 comprises no reverser elements 106. Instead, the lower PAHT 100 of FIG. 10 comprises only bend elements 104 and adapter elements 108. This embodiment of the lower PAHT 100 demonstrates that a PAHT 100 may comprise as few as zero reverser elements 106 while still being capable of engaging a component of a wellbore using teeth 136 (e.g., against the inner wall of casing 202) to hold a wellbore servicing device 220 in a selected location. For example, one or more bend elements 104 and/or adapter elements 108 located at or proximate the lower end of the lower PAHT 100 may have teeth engaging the inner wall of casing 202. This embodiment of the lower PAHT 100 also demonstrates that a PAHT 100 may comprise as few as zero reverser elements 106 while still being capable centralizing and/or decentralizing a wellbore servicing device 220.

Referring now to FIGS. 11-14, a wellbore servicing method is shown in which PAHTs 100 are selectively used to maintain a position of a wellbore servicing device 220 (e.g., a pinpoint fracturing device such as a fluid-jetting perforation/fracturing device) and in which PAHTs 100 are used to centralize the wellbore servicing device 220. FIG. 11-14 show a wellbore servicing device 220 as comprising a plurality of fluid jetting ports 224 and the casing 202 and wellbore 200 as generally comprising perforation targets 226. Most generally, the wellbore servicing method may be described as comprising (1) lowering the PAHTs 100 and wellbore servicing device 220 into the wellbore, (2) optionally observing longitudinal displacement of the location of the PAHTs 100 and the wellbore servicing device 220 due to increased temperature, (3) optionally flowing fluids through the workstring carrying the PAHTs 100 and the wellbore servicing device 220 to shorten the workstring (via cooling) and longitudinally displace the PAHTs 100 and the wellbore servicing device 220, (4) applying fluid pressure to the PAHTs 100 and the wellbore servicing device 220 to actuate the PAHTs 100 and operate the wellbore servicing device 220, and (5) reducing the pressure the PAHTs 100 and the wellbore servicing device 220 to relax and/or unactuate the PAHTs 100 and/or discontinue operation of the wellbore servicing device 220. As a result of the above-described operation, perforations and/or fractures 228 may be formed in the casing 202 and/or the formation 204. The resulting perforations and/or fractures 228 may thereafter be used during a hydrocarbon production process in which hydrocarbon matter flows into the wellbore 200 from the formation 204 through the perforations and/or fractures 228.

Figure 11:
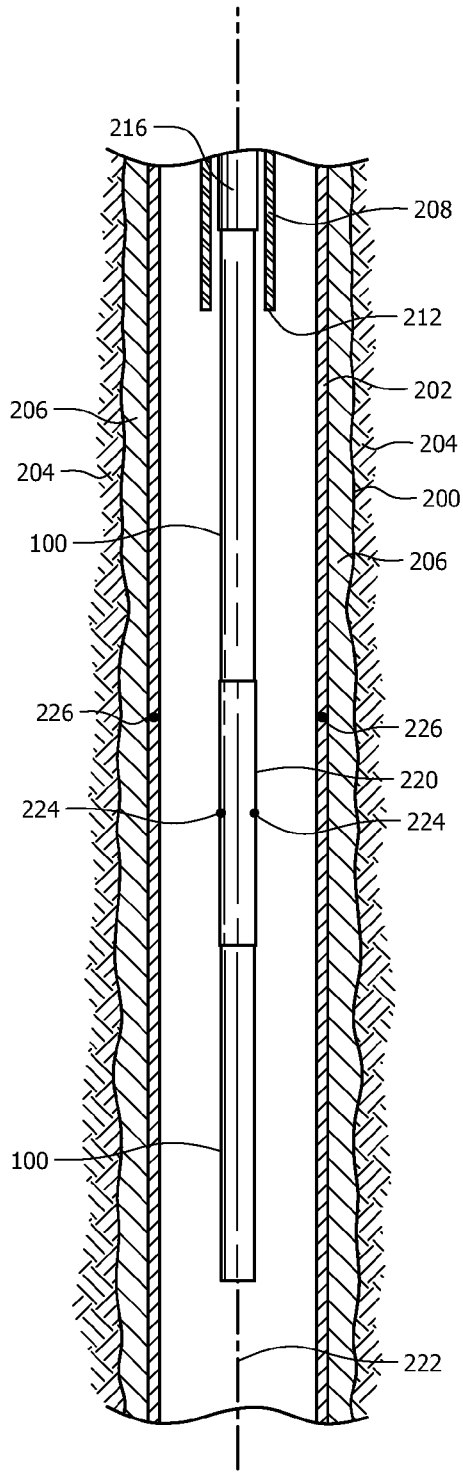
FIG. 11 is a partial cut-away view of two PAHTs of FIG. 1 as used in the context of a wellbore for performing a wellbore servicing method using a wellbore servicing device, showing the PAHTs and the wellbore servicing device as initially located.

Referring to FIG. 11, wellbore servicing method may comprise lowering the PAHTs 100 and the wellbore servicing device 220 into the wellbore 200 via a workstring. Upon initial introduction into the wellbore 200, the workstring components (i.e., the coiled tubing 216, PAHTs 100, wellbore servicing device 220, and any other interconnected components within the wellbore 200) may generally comprise an initial temperature that results in the workstring having an initial overall length within the wellbore 200. In some embodiments, the fluid jetting ports 224 of the wellbore servicing device 220 may be located downhole and/or longitudinally offset from the location of the perforation targets 226 while the components substantially comprise the initial temperature.

Figure 12:
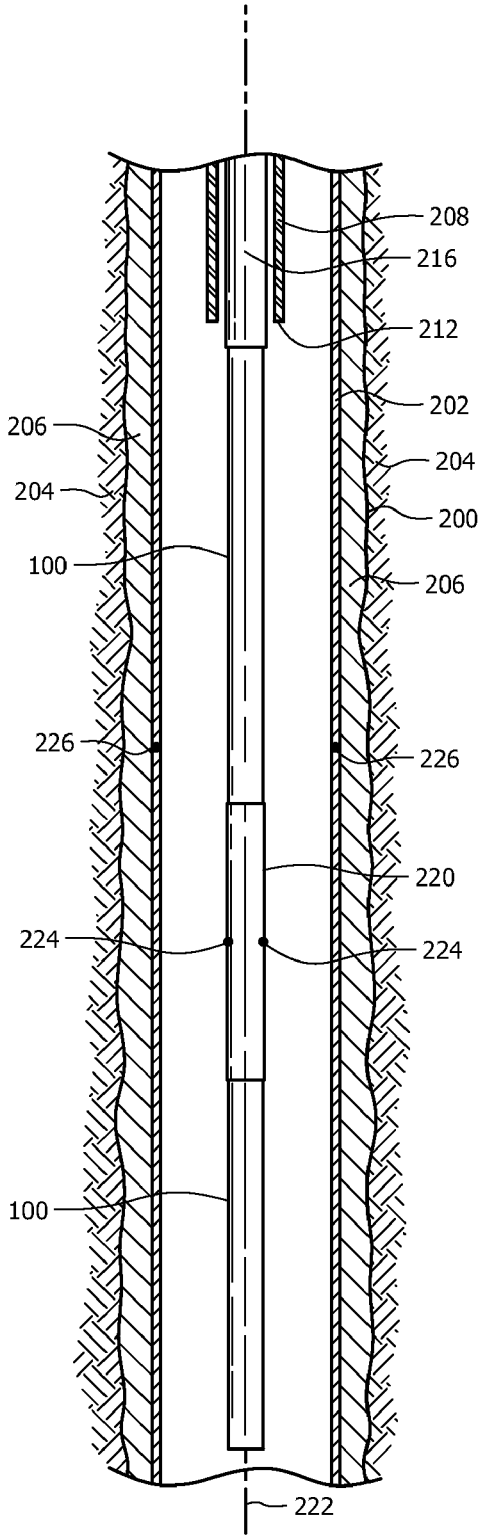
FIG. 12 is a partial cut-away view of two PAHTs of FIG. 11 as located due to an increase in temperature.

Referring to FIG. 12, it is shown that the workstring and/or the attached components may optionally (depending upon wellbore conditions) longitudinally expand due to an increase in temperature of the components. Such expansion may cause the fluid jetting ports 224 to become located even further downhole of the perforation targets 226.

Figure 13:
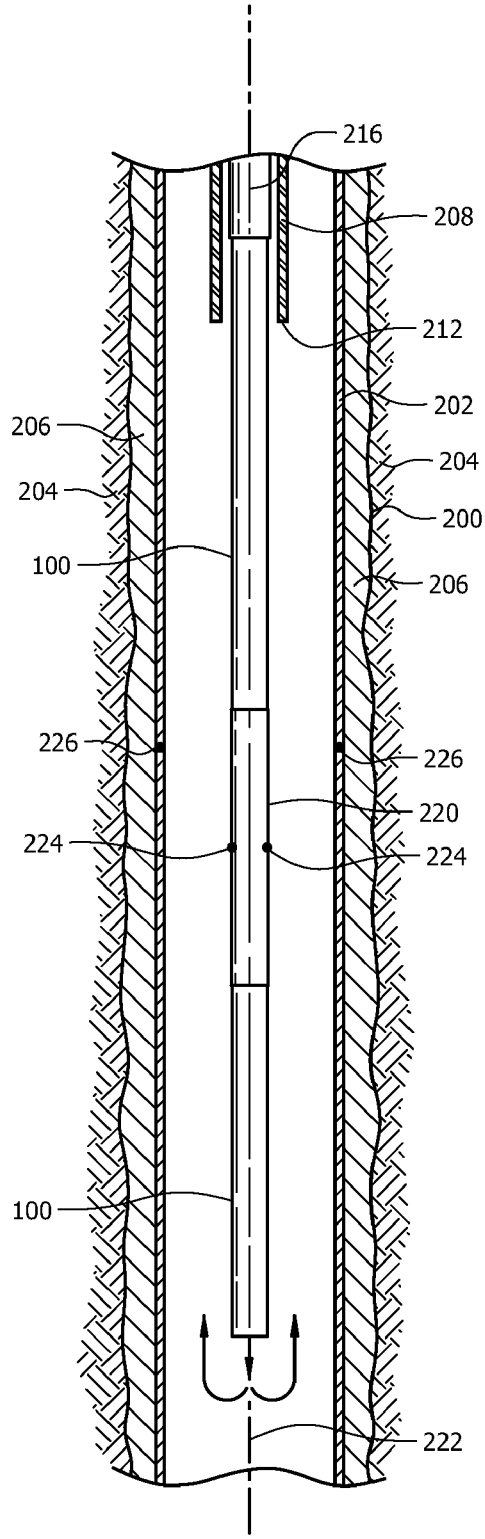
FIG. 13 is partial cut-away view of two PAHTs of FIG. 11 as located due to a reduction in temperature achieve by fluid circulation.

Referring to FIG. 13, it is shown that fluid may optionally be circulated through the workstring and/or the attached components to reduce the temperature of the workstring and/or the attached components. After sufficient circulation of fluid through the workstring, the workstring may contract (i.e., shorten) and thereby cause the fluid jetting ports 224 to become located closer to the perforation targets 226. In some embodiments, the temperature of the circulated fluid may be selected at substantially the same temperature as the fluid that is to later be ejected through fluid jetting ports 224 during operation of the wellbore servicing device 220, thereby avoiding further undesirable lengthening or contracting of the workstring.

Figure 14:
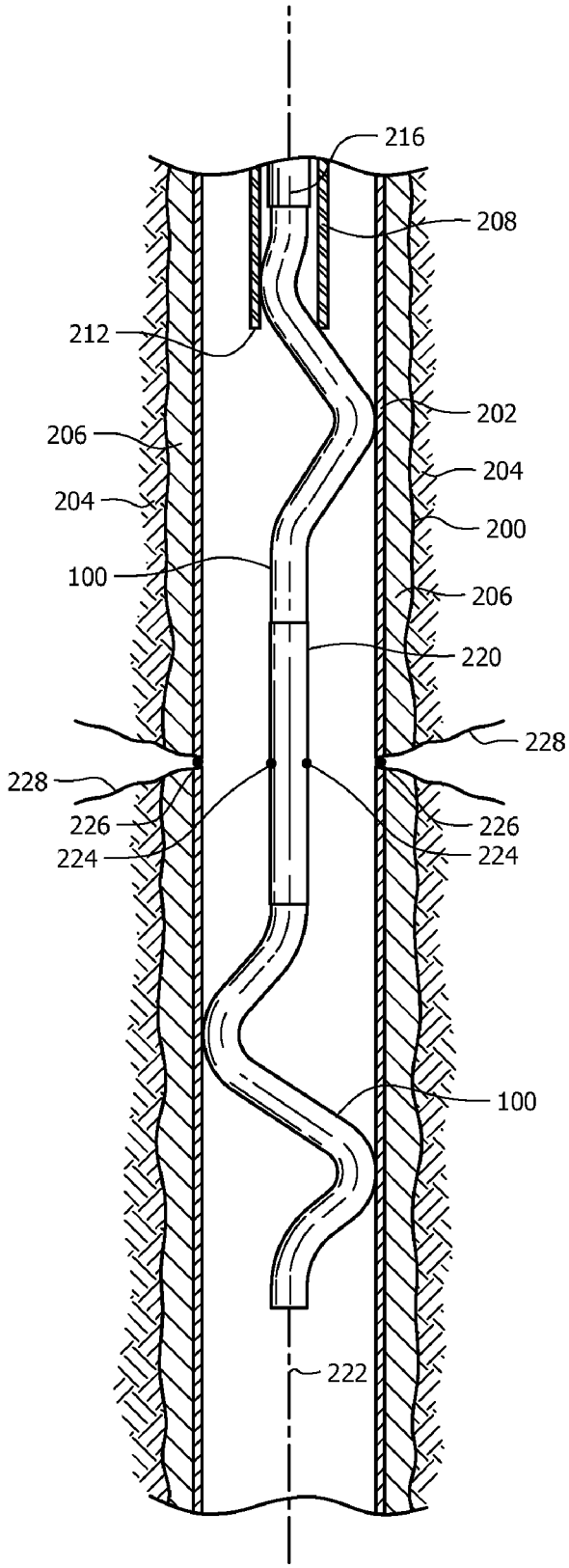
FIG. 14 is a partial cut-away view of the two PAHTs of FIG. 11 in an actuated state due to an increase in fluid pressure applied to the PAHTs.

Referring to FIG. 14, after optionally circulating the fluid through the workstring, a second fluid may be provided to the PAHTs 100 and the wellbore servicing device 220 through the workstring. The second fluid may comprise an abrasive wellbore servicing fluid (such as a fracturing fluid, a particle laden fluid, a cement slurry, etc.) that is flowed through the fluid jetting ports 224. In an embodiment, the second fluid is an abrasive fluid comprising from about 0.5 to about 1.5 pounds of abrasives and/or proppants per gallon of the mixture (lbs/gal), alternatively from about 0.6 to about 1.4 lbs/ gal, alternatively from about 0.7 to about 1.3 lbs/gal. The second fluid may generally be pumped through the PAHTs 100 and the wellbore servicing device 220 at a fluid pressure sufficient to actuate the PAHTs 100 as well as begin operation of the wellbore servicing device 220. In response to the actuation of the PAHTs 100, the overall longitudinal length of the PAHTs 100 may be decreased due to the resulting undulating and/or curved profile of the PAHTs 100. In response to the shortening of the PAHTs 100, the fluid jetting ports 224 may be brought into closer alignment with the perforation targets 226. It will be appreciated that once the PAHTs 100 are sufficiently actuated to cause engagement of teeth 136 with components of the wellbore 200 (e.g. casing 202 and/or tubular 208), the location of the fluid jetting ports 224 may be substantially held in place relative to the perforation targets 226 by a longitudinal holding force of the PAHTs 100. In some embodiments, pressurizing a PAHT 100 at about 1000 psi may result in about 400 lbf of longitudinal holding force per the number of elements 104, 106, 108 fully engaged with the casing 202 and/or other wall within the wellbore 200. In some embodiments, pressurizing a PAHT 100 at about 5000 psi may result in about 2000 lbf to about 3000 lbf of longitudinal holding force per the number of elements 104, 106, 108 fully engaged with the casing 202 and/or other wall within the wellbore 200. It will be appreciated that the longitudinal holding force provided by any PAHT 100 may be a matter of both design choice (e.g., configuration of teeth 136, configuration of elements 104, 106, 108, etc.) as well as a function of actual wellbore conditions.

In some embodiments, the second fluid may be pumped down at a sufficient flow rate and pressure to form fluid jets through the fluid jetting ports 224 at a velocity of from about 300 to about 700 feet per second (ft/sec), alternatively from about 350 to about 650 ft/sec, alternatively from about 400 to about 600 ft/sec for a period greater than about 2 minutes, alternatively for a period of about 2 minutes to about 500 minutes, alternatively for a period of about 3 minutes to about 9 minutes, and/or for any other suitable period at any other suitable flow rate. In some embodiments, the pressure of second fluid may be increased from about 2000 to about 5000 psig, alternatively from about 2500 to about 4500 psig, alternatively from about 3000 to about 4000 psig and the pumping down of the second fluid may be continued at a constant pressure for a period of time. It will be appreciated that flowing the second fluid through the PAHTs 100 and the wellbore servicing device 220 may result in perforations and/or fractures 228 extending through the casing 202 and into the formation 204. In an embodiment, additional fluid is pumped down the annulus between the casing 202 and the tubing string 208 concurrent with and/or subsequent to the formation of perforations and/or fractures 228, and such additional fluid may be pumped at relatively high volumes in comparison to the flow rate of fluid jetted from wellbore servicing device 220, thereby aiding in the formation and/or extension of fractures in the surrounding formation.

Subsequent to the formation of the perforations and/or fractures 228, the flow of the second fluid through the PAHTs 100 and the wellbore servicing device 220 may be reduced and/or altogether discontinued. With a sufficient reduction in fluid pressure supplied to the PAHTs 100, the PAHTs 100 may return to their unactuated state as they are shown in FIG. 11. With the passage of a sufficient period of time of no fluid circulation through the workstring, the temperature of the workstring may again rise and result in the PAHTs 100 and the wellbore servicing device 220 being located as shown in FIG. 12. It will be appreciated that with proper use of wellbore zonal isolation devices (e.g., packers), hydrocarbon production may begin by flowing hydrocarbon laden fluids from the formation 204 through the perforations and/or fractures 228 and into the workstring.

Generally, this disclosure at least describes systems and method for maintaining a location of a wellbore servicing device. In some embodiments, the location of a wellbore servicing device may be maintained by a PAHT 100 in spite of forces transmitted to the PAHT 100 due to temperature related expansion and/or contraction of components of a workstring, for example caused by flowing fluid through the workstring and/or due to ambient temperature differentials. This disclosure provides PAHTs 100 that, in some embodiments, are pressure activated in response to the requisite pressure for operating an attached wellbore servicing device 220. In alternative embodiments, the PAHTs 100 may be configured to actuate at a pressure lower than the pressure required to operate an attached wellbore servicing device 220. Further, this disclosure makes clear that the PAHTs 100 may be configured and/or designed to centralize and/or decentralize an attached wellbore servicing device 220. The PAHTs 100 disclosed herein conveniently discontinue maintaining a location of an attached wellbore servicing device 220 and/or discontinue centralizing and/or decentralizing an attached wellbore servicing device 220 in response to an adequate reduction in fluid pressure applied to the PAHTs 100.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference in their entireties.

What I claim as my invention is:

1. A method of maintaining a location of a wellbore servicing device, comprising:

connecting a pressure activated hold-down tool to the wellbore servicing device;

delivering the wellbore servicing device and the pressure activated hold-down tool into a wellbore;

selectively causing the pressure activated hold-down tool to lie in an undulating curvature from a longitudinal axis of the pressure activated hold-down tool in response to a change in a fluid pressure; and engaging the pressure activated hold-down tool with a feature of a wellbore to prevent longitudinal movement of the wellbore servicing device.

2. The method of claim 1, further comprising:

engaging a tooth of the pressure activated hold-down tool with the feature of the wellbore.

3. The method of claim 2, wherein the feature of the wellbore comprises a casing of the wellbore.

4. The method of claim 2, wherein the feature of the wellbore comprises a wall of a formation.

5. The method of claim 1, further comprising:

selectively centralizing at least a portion of the pressure activated hold-down tool in response to the change in the fluid pressure.

6. The method of claim 1, further comprising:

selectively centralizing at least a portion of the wellbore servicing device in response to the change in the fluid pressure.

7. The method of claim 1, further comprising:

decreasing the pressure to disengage the pressure activated hold-down tool from the feature of the wellbore.

8. A pressure activated hold-down tool for a wellbore, comprising:

pressure actuated elements configured to cooperate to selectively provide an unactuated state in which the pressure activated hold-down tool lies substantially along a longitudinal axis and the pressure actuated elements are further configured to cooperate to selectively lie in an undulating curvature from the longitudinal axis in response to a change in pressure applied to the pressure activated hold-down tool;

wherein at least one of the pressure actuated elements comprises a tooth configured for selective resistive engagement with a feature of the wellbore.

9. The pressure activated hold-down tool of claim 8, wherein a first tooth is carried by a first pressure actuated element and a second tooth is carried by a second pressure actuated element and wherein the first tooth is configured for engagement with a first feature of the wellbore and the second tooth is configured for engagement the a second feature of the wellbore in response to the change in pressure, the second feature of the wellbore being located at least one of angularly offset from the first feature of the wellbore about the longitudinal axis and longitudinally offset from the first feature of the wellbore along the longitudinal axis.

10. The pressure activated hold-down tool of claim 9, wherein the second feature of the wellbore is located angularly offset from the first feature of the wellbore about the longitudinal axis by about 180 degrees.

11. The pressure activated hold-down tool of claim 8, comprising:

an adapter element that lies substantially centralized with the longitudinal axis in response to the change in pressure.

12. A pressure activated hold-down tool for a wellbore, comprising:

pressure actuated elements configured to cooperate to selectively provide an unactuated state in which the pressure activated hold-down tool lies substantially along a longitudinal axis and the pressure actuated elements are further configured to cooperate to selectively lie increasingly deviated from the longitudinal axis in response to a change in pressure applied to the pressure activated hold down tool;

wherein at least one of the pressure actuated elements comprises a tooth configured for selective resistive engagement with a feature of the wellbore, and a reverser element configured to cause a change in a sign of a slope of a curvature of the pressure activated hold-down tool when the pressure activated hold-down tool is in the actuated state.

13. The pressure activated hold-down tool of claim 12, wherein the tooth is carried by the reverser element.

14. The pressure activated hold-down tool of claim 12, wherein the tooth is carried by at least one pressure activated element other than the reverser element.

15. A pressure activated hold-down tool for a wellbore, comprising:

pressure actuated elements configured to cooperate to selectively provide an unactuated state in which the pressure activated hold-down tool lies substantially along a longitudinal axis and the pressure actuated elements are further configured to cooperate to selectively lie increasingly deviated from the longitudinal axis in response to a change in pressure applied to the pressure activated hold-down tool;

wherein at least one of the pressure actuated elements comprises a tooth configured for selective resistive engagement with a feature of the wellbore, and an adapter element that lies selectively decentralized relative to the longitudinal axis in response to the change in pressure.

16. A method of servicing a wellbore, comprising:

delivering a pressure activated hold-down tool into the wellbore, the pressure activated hold-down tool being connected to a wellbore servicing device;

increasing a pressure applied to the pressure activated hold-down tool and the wellbore servicing device;

in response to the increasing the pressure, causing the pressure activated hold-down tool to lie in an undulating curvature from a longitudinal axis of the pressure activated hold-down tool;

engaging the pressure activated hold-down tool with a feature of the wellbore to resist a longitudinal movement of at least one of the pressure activated hold-down tool and the wellbore servicing device; and servicing the wellbore using the wellbore servicing device.

17. The method of claim 16, further comprising:

in response to the increasing the pressure, centralizing at least a portion of at least one of the pressure activated hold-down tool and the wellbore servicing device.

18. The method of claim 16, wherein the curvature comprises a three-dimensional curve.

19. The method of claim 16, wherein the pressure activated hold-down tool is located uphole relative to the wellbore servicing device.

20. The method of claim 16, wherein the wellbore servicing performed is chosen from a group of wellbore services consisting of fracturing services, tubing punching services, perforation gun services, zonal isolation services, packer services, and acid work services.

21. A method of servicing a wellbore, comprising:

delivering a pressure activated hold-down tool into the wellbore, the pressure activated hold-down tool being, connected to a wellbore servicing device;

increasing a pressure applied to the pressure activated hold-down tool and the wellbore servicing device:

in response to the increasing the pressure, increasing a deviation of a curvature of the pressure activated hold-down tool from a longitudinal axis of the pressure activated hold-down tool;

engaging the pressure activated hold-down tool with a feature of the wellbore to resist a longitudinal movement of at least one of the pressure activated hold-down tool and the wellbore servicing device; and servicing the wellbore using the wellbore servicing device, wherein the pressure activated hold-down tool is at least partially passed through a tubing having a first inner diameter and the pressure activated hold-down tool is passed into a casing having a second inner diameter, the first inner diameter being smaller than the second inner diameter by between about 5 percent to about 80 percent, prior to substantially increasing the deviation.

22. A method of servicing a wellbore, comprising:

delivering a pressure activated hold-down tool into the wellbore, the pressure activated hold-down tool being connected to a wellbore servicing device;

increasing a pressure applied to the pressure activated hold-down tool and the wellbore servicing device;

in response to the increasing the pressure, increasing a deviation of a curvature of the pressure activated hold-down tool from a longitudinal axis of the pressure activated hold-down tool;

engaging the pressure activated hold-down tool with a feature of the wellbore to resist a longitudinal movement of at least one of the pressure activated hold-down tool and the wellbore servicing device; and servicing the wellbore using the wellbore servicing device, wherein the pressure activated hold-down tool is located downhole relative to the wellbore servicing device.

* * * * *